US006482100B1

(12) United States Patent
Bacon

(10) Patent No.: US 6,482,100 B1
(45) Date of Patent: Nov. 19, 2002

(54) GOLF PUTTER HAVING A REFLECTIVE FACE AND ALIGNMENT GUIDE

(76) Inventor: Arch Bacon, 4707 Park Jacaranda, Calabasas, CA (US) 91302

( * ) Notice: Subject to any disclaimer, the term of this patent is extended or adjusted under 35 U.S.C. 154(b) by 0 days.

(21) Appl. No.: 09/948,183

(22) Filed: Sep. 7, 2001

Related U.S. Application Data

(60) Provisional application No. 60/231,344, filed on Sep. 8, 2000.

(51) Int. Cl.[7] ..... A63B 69/36

(52) U.S. Cl. ..... 473/240; 473/251

(58) Field of Search ..... 473/267, 268, 473/240, 242, 252, 241, 251, 254, 253, 255, 340, 313, 305, 288; D21/737; 33/289, 508

(56) References Cited

U.S. PATENT DOCUMENTS 2,503,506 A * 4/1950 Miller
3,421,765 A * 1/1969 Scott
D234,782 S * 4/1975 Creed
3,880,430 A * 4/1975 McCabe
D245,439 S * 8/1977 Thiel
4,367,877 A * 1/1983 Gibson
4,601,472 A * 7/1986 O'Flanagan
4,844,468 A * 7/1989 Lee
4,919,424 A * 4/1990 Fukumochi
5,433,444 A * 7/1995 Chiuminatta
RE37,519 E * 1/2002 Densberger

* cited by examiner

*Primary Examiner*—Sebastiano Passaniti
(74) *Attorney, Agent, or Firm*—Goldstein & Lavas, P.C.

(57) ABSTRACT

A golf putter having a reflective face and alignment guide including a head portion having a forward face and a rearward face. The head portion has an upper end and a lower end. The upper end has a collar extending upwardly therefrom for receiving a golf shaft therein. The forward face has an upper section and a lower section. The lower section is vertically oriented and essentially perpendicular to the lower end. The upper section is angularly disposed and essentially less than forty-five degrees with respect to the lower section. The upper section has a mirror secured thereto. An alignment tab is secured to and extends rearwardly from the upper end of the head portion. The alignment tab has a central alignment recess formed therein. The recess has a forward end disposed above the mirror secured to the upper section of the head portion.

1 Claim, 2 Drawing Sheets

GOLF PUTTER HAVING A REFLECTIVE FACE AND ALIGNMENT GUIDE

This application claims the benefit of Provisional Application No. 60/231,340 filed Sep. 8, 2000.

BACKGROUND OF THE INVENTION

The present invention relates to a golf putter having a reflective face and alignment guide and more particularly pertains to allowing a golfer to see the golf hole while addressing a golf ball without having to lift up their head.

The game of golf is rapidly becoming one of the worlds favorite leisure activities. Each year more and more people are taking up the game. Golf, however, remains one of the more difficult games to master. Furthermore, most novice players struggle to play the game satisfactorily. These players are constantly looking for new types of golf equipment that might give them the smallest improvement in their game.

The present invention seeks to solve the abovementioned problem by providing a new golf putter that will allow the golfer to improve one facet of their game, putting. The present invention provides a reflective front face that will allow the golfer to visualize the golf ball and the hole at the same time thereby effectively eliminating the need for raising their head in order to see the hole.

The use of golf club devices is known in the prior art. More specifically, golf club devices heretofore devised and utilized for the purpose of aiding a golfer in playing golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,195,749 to Ugarte discloses a golf club head with a middle section inclined to act as a mirror for use in lining up a shot. U.S. Pat. No. 5,640,777 to Densberger and 5,776,016 to Benoit disclose additional golf clubs with optical alignment means incorporated. U.S. Pat. No. Des. 239,637 to Loggins discloses the ornamental design for a reflective golf putter head.

While these devices fulfill their respective, particular objective and requirements, the aforementioned patents do not describe a golf putter having a reflective face and alignment guide for allowing a golfer to see the golf hole while addressing a golf ball without having to lift up their head.

In this respect, the golf putter having a reflective face and alignment guide according to the present invention substantially departs from the conventional concepts and designs of the prior art, and in doing so provides an apparatus primarily developed for the purpose of allowing a golfer to see the golf hole while addressing a golf ball without having to lift up their head.

Therefore, it can be appreciated that there exists a continuing need for a new and improved golf putter having a reflective face and alignment guide which can be used for allowing a golfer to see the golf hole while addressing a golf ball without having to lift up their head. In this regard, the present invention substantially fulfills this need.

SUMMARY OF THE INVENTION

In the view of the foregoing disadvantages inherent in the known types of golf club devices now present in the prior art, the present invention provides an improved golf putter having a reflective face and alignment guide. As such, the general purpose of the present invention, which will be described subsequently in greater detail, is to provide a new and improved golf putter having a reflective face and alignment guide which has all the advantages of the prior art and none of the disadvantages.

To attain this, the present invention essentially comprises a head portion having a forward face and a rearward face. The head portion has an upper end and a lower end. The upper end has a collar extending upwardly therefrom for receiving a golf shaft therein. The forward face has an upper section and a lower section. The lower section is vertically oriented and essentially perpendicular to the lower end. The upper section is angularly disposed and essentially less than forty-five degrees with respect to the lower section. The upper section has a mirror secured thereto. An alignment tab is secured to and extends rearwardly from the upper end of the head portion. The alignment tab has a central alignment recess formed therein. The recess has a forward end disposed above the mirror secured to the upper section of the head portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf putter having a reflective face and alignment guide which has all the advantages of the prior art golf club devices and none of the disadvantages.

It is another object of the present invention to provide a new and improved golf putter having a reflective face and alignment guide which may be easily and efficiently manufactured and marketed.

It is a further object of the present invention to provide a new and improved golf putter having a reflective face and alignment guide which is of durable and reliable construction.

An even further object of the present invention is to provide a new and improved golf putter having a reflective face and alignment guide which is susceptible of a low cost of manufacture with regard to both materials and labor, and which accordingly is then susceptible of low prices of sale to the consuming public, thereby making such a golf putter having a reflective face and alignment guide economically available to the buying public.

Even still another object of the present invention is to provide a new and improved golf putter having a reflective face and alignment guide for allowing a golfer to see the golf hole while addressing a golf ball without having to lift up their head.

Lastly, it is an object of the present invention to provide a new and improved golf putter having a reflective face and alignment guide including a head portion having a forward face and a rearward face. The head portion has an upper end and a lower end. The upper end has a collar extending upwardly therefrom for receiving a golf shaft therein. The forward face has an upper section and a lower section. The lower section is vertically oriented and essentially perpendicular to the lower end. The upper section is angularly disposed and essentially less than forty-five degrees with respect to the lower section. The upper section has a mirror secured thereto. An alignment tab is secured to and extends rearwardly from the upper end of the head portion. The alignment tab has a central alignment recess formed therein. The recess has a forward end disposed above the mirror secured to the upper section of the head portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
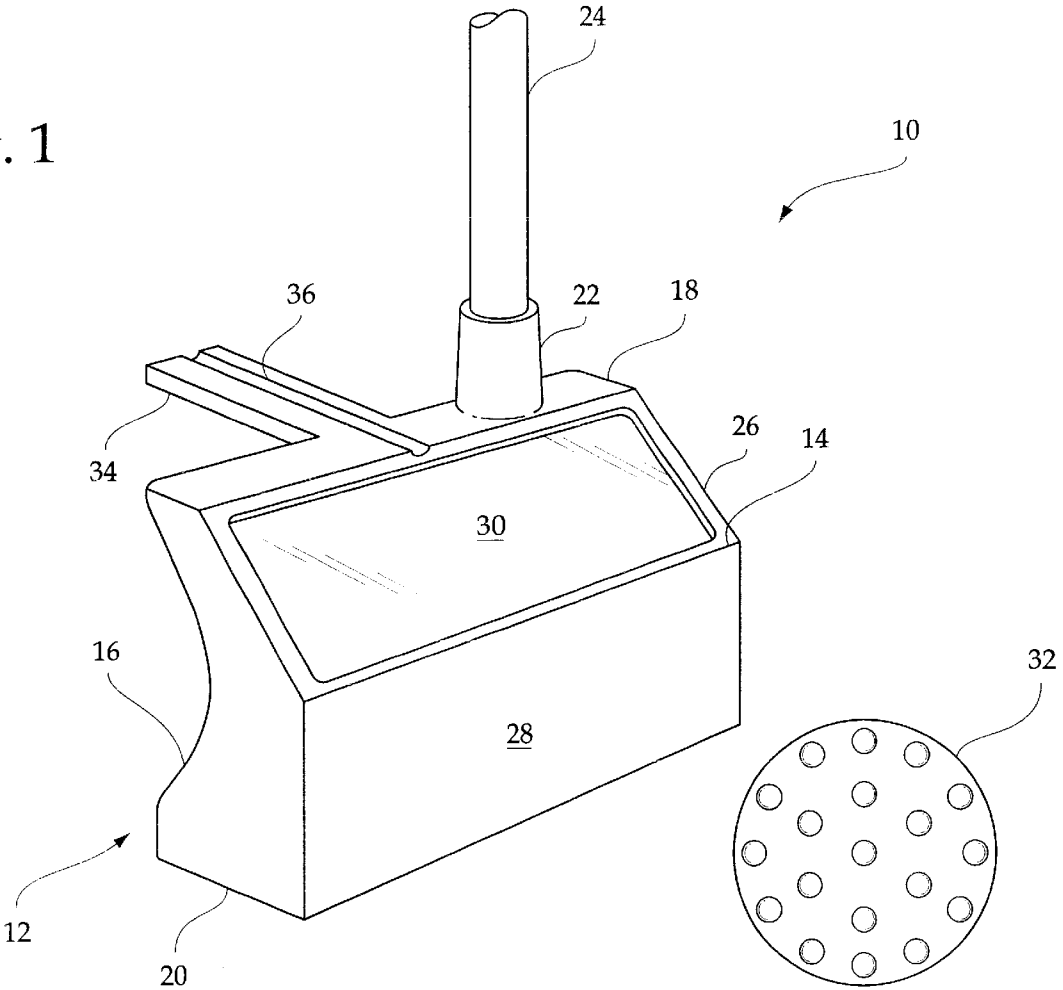
FIG. 1 is a perspective view of the preferred embodiment of the golf putter having a reflective face and alignment guide constructed in accordance with the principles of the present invention.
Figure 2:
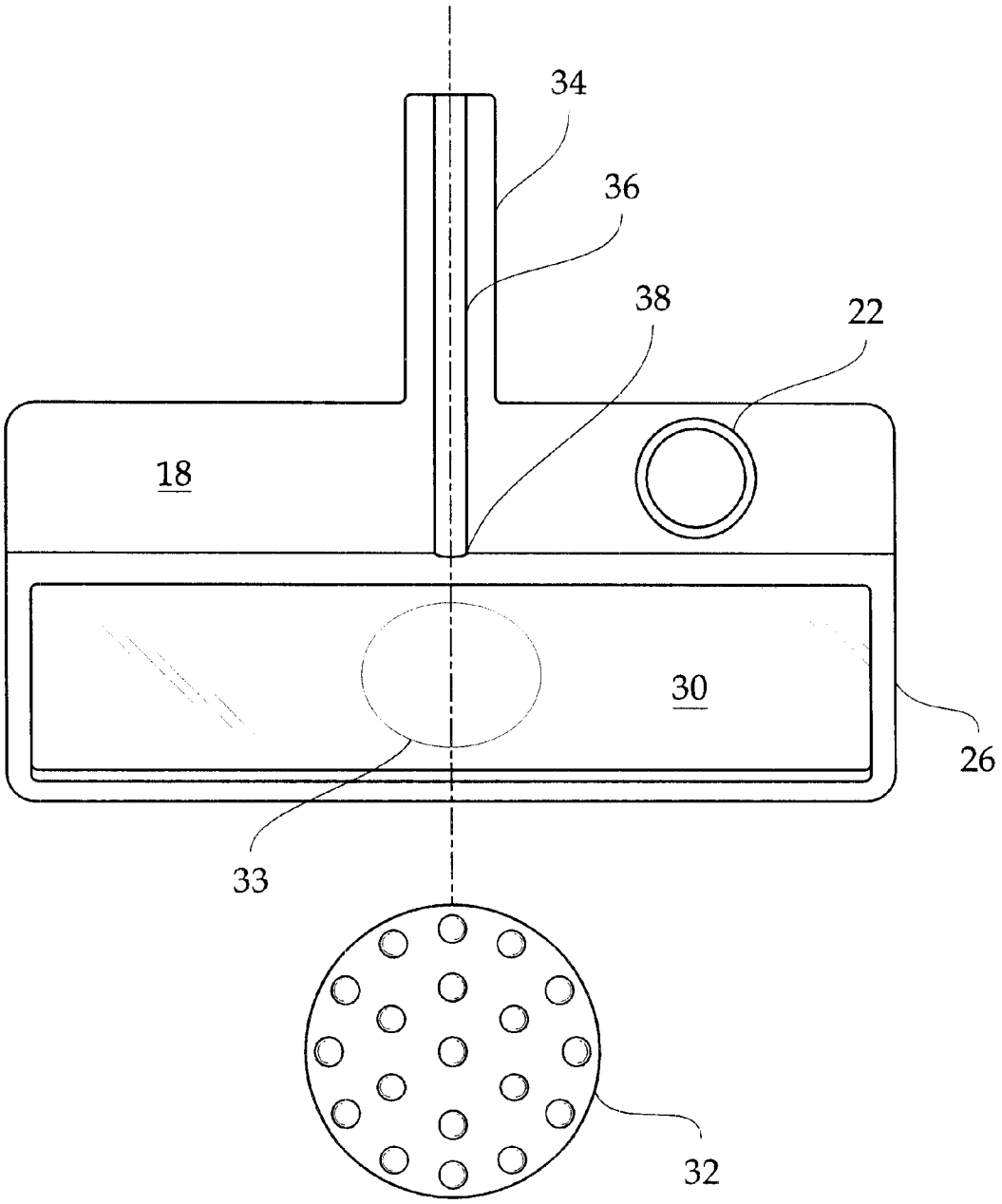
FIG. 2 is a top plan view of the present invention.

With reference now to the drawings, and in particular, to FIGS. 1 and 2 thereof, the preferred embodiment of the new and improved golf putter having a reflective face and alignment guide embodying the principles and concepts of the present invention and generally designated by the reference number 10 will be described.

Specifically, it will be noted in the various figures that the device relates to a golf putter having a reflective face and alignment guide for allowing a golfer to see the golf hole while addressing a golf ball without having to lift up their head. In its broadest context, the device consists of a head portion and an alignment tab. Such components are individually configured and correlated with respect to each other so as to attain the desired objective.

The head portion 12 has a forward face 14 and a rearward face 16. The rearward face 16 is shown in an arcuate configuration. This configuration is not critical and can be changed to suit other needs. The head portion 12 has an upper end 18 and a lower end 20. The upper end 18 has a collar 22 extending upwardly therefrom for receiving a golf shaft 24 therein. The forward face 14 has an upper section 26 and a lower section 28. The lower section 28 is vertically oriented and essentially perpendicular to the lower end 20. The upper section 26 is angularly disposed and essentially less than forty-five degrees with respect to the lower section 28. The upper section 26 has a mirror 30 secured thereto. When the head portion 12 is positioned behind a golf ball 32, the mirror 30 allows the golfer to look down to align the golf ball 32 with the lower section 28 while also seeing the hole 33 through the mirror 30. The golfer will manually adjust the angle of the head portion 12 in order to see the hole. This eliminates the need for the golfer to alternate between looking down at the ball 32 and looking up to see the hole 33.

The alignment tab 34 is secured to and extends rearwardly from the upper end 18 of the head portion 12. The alignment tab 34 has a central alignment recess 36 formed therein. The recess 36 has a forward end 38 disposed above the mirror 30 secured to the upper section 26 of the head portion 12. The alignment tab 34 provides a marker for aligning with a center of the golf ball 32 so that the ball 32 can be struck at the optimal location of the head portion 12 towards the hole 33. As to the manner of usage and operation of the present invention, the same should be apparent from the above description.

Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf putter having a reflective face and alignment guide for allowing a golfer to see the golf hole while addressing a golf ball without having to lift up their head, the golf putter comprising, in combination:

a head portion having a forward face and a rearward face, the head portion having an upper end and a lower end, the upper end having a collar extending upwardly therefrom for receiving a golf shaft therein, the forward face having an upper section and a lower section, the lower section being vertically oriented and essentially perpendicular to the lower end, the upper section being angularly disposed and essentially less than forty-five degrees with respect to the lower section, the upper section having a mirror secured thereto; and an alignment tab secured to and extending rearwardly from the upper end of the head portion, the alignment tab having a central alignment recess formed therein, the recess having a forward end disposed above the mirror secured to the upper section of the head portion.

* * * * *